US011360411B2

(12) United States Patent
Lee et al.

(10) Patent No.: US 11,360,411 B2
(45) Date of Patent: Jun. 14, 2022

(54) TONER REFILL CARTRIDGE CONNECTED TO MAIN BODY THROUGH INTERFACE BETWEEN DEVELOPMENT CARTRIDGE AND MAIN BODY

(71) Applicant: HEWLETT-PACKARD DEVELOPMENT COMPANY, L.P., Spring, TX (US)

(72) Inventors: SeungSup Lee, Suwon-si (KR); Jinwoo Noh, Yongin-si (KR); Young Ju Lee, Suwon-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/050,158

(22) PCT Filed: Nov. 22, 2018

(86) PCT No.: PCT/KR2018/014409
§ 371 (c)(1),
(2) Date: Oct. 23, 2020

(87) PCT Pub. No.: WO2020/045747
PCT Pub. Date: Mar. 5, 2020

(65) Prior Publication Data

US 2021/0080871 A1 Mar. 18, 2021

(30) Foreign Application Priority Data

Aug. 30, 2018 (KR) ..... 10-2018-0102566

(51) Int. Cl.
*G03G 15/08* (2006.01)
*G03G 15/00* (2006.01)

(52) U.S. Cl.
CPC ..... *G03G 15/0894* (2013.01); *G03G 15/50* (2013.01)

(58) Field of Classification Search
CPC ..... G03G 15/0865; G03G 15/0894; G03G 15/50; G03G 21/1652; G03G 21/1892
See application file for complete search history.

(56) References Cited

U.S. PATENT DOCUMENTS 3,599,682 A * 8/1971 Altmann ..... G03G 15/0884 141/106
3,651,838 A * 3/1972 Albert ..... G03G 15/0855 141/284

(Continued)

FOREIGN PATENT DOCUMENTS

EP 1041455 10/2000
EP 3717969 10/2019

(Continued)

*Primary Examiner* — David J Bolduc
(74) *Attorney, Agent, or Firm* — Staas & Halsey LLP

(57) ABSTRACT

An image forming apparatus includes a main body, a development cartridge supplying toner accommodated in a toner accommodating portion to an electrostatic latent image formed on a photoconductor to form a toner image, a toner refilling portion in the development cartridge and on which a toner refill cartridge for refilling toner in the toner accommodating portion is mounted, and a controller controlling operations of the image forming apparatus based on a connection between the development cartridge mounted on the main body and the toner refill cartridge mounted on the toner refilling portion. The toner refilling portion connects the toner refill cartridge to the main body through an interface between the development cartridge and the main body.

15 Claims, 9 Drawing Sheets

(56) References Cited

U.S. PATENT DOCUMENTS 4,456,154 A * 6/1984 Herriman ..... G03G 15/0875 141/363
4,561,567 A * 12/1985 Wittstein ..... G03G 15/0884 141/330
4,839,691 A * 6/1989 Tagawa ..... G03G 15/0896 222/DIG. 1
5,074,344 A * 12/1991 Vacek ..... G03G 15/0875 141/363
5,079,591 A * 1/1992 Tomita ..... G03G 15/0855 399/262
5,614,996 A * 3/1997 Tanda ..... G03G 21/12 141/363
5,742,877 A * 4/1998 Okada ..... G03G 15/0882 399/106
5,802,431 A * 9/1998 Nagashima ..... G03G 15/0874 399/262
5,887,232 A * 3/1999 Phillips ..... G03G 15/0855 399/262
6,212,338 B1 * 4/2001 Hagihara ..... G03G 15/0863 399/12
6,249,654 B1 * 6/2001 Kurz ..... G03G 15/087 399/12
6,304,739 B1 * 10/2001 Katsuyama ..... G03G 15/0874 222/DIG. 1
6,393,241 B1 * 5/2002 Matsumoto ..... G03G 15/0822 399/258
6,473,571 B1 * 10/2002 Wegman ..... B41J 2/17533 399/12
6,507,720 B2 * 1/2003 Kabumoto ..... G03G 15/0126 399/258
6,628,908 B2 * 9/2003 Matsumoto ..... G03G 15/0898 222/325
6,648,218 B2 * 11/2003 Katsuyama ..... G03G 15/0874 229/117.35
6,748,190 B2 * 6/2004 Yanagisawa ..... G03G 15/0865 222/DIG. 1
6,970,659 B2 * 11/2005 Serizawa ..... G03G 21/1889 399/25
7,139,494 B2 * 11/2006 Ono ..... G03G 21/1892 399/12
7,389,071 B2 * 6/2008 Katsuyama ..... G03G 15/0874 399/258
7,643,776 B2 * 1/2010 Walton ..... B41J 2/175 399/237
7,959,270 B2 * 6/2011 Durham ..... G03G 15/0855 347/85
8,824,922 B2 * 9/2014 Suzuki ..... G03G 21/105 399/120
8,929,776 B2 * 1/2015 Yamabe ..... G03G 15/0879 399/258
9,658,590 B2 5/2017 Acosta et al.
9,836,018 B2 12/2017 Amann et al.
11,055,038 B2 * 7/2021 Lavigne ..... B41J 2/17546
11,066,214 B2 * 7/2021 Nakamura ..... D21F 9/00
2001/0041083 A1 * 11/2001 Terazawa ..... G03G 15/0865 399/258
2002/0009310 A1 * 1/2002 Kabumoto ..... G03G 15/0126 399/258
2002/0039502 A1 * 4/2002 Matsumoto ..... G03G 15/0877 399/258
2003/0081968 A1 * 5/2003 Minagawa ..... G03G 15/0877 399/258
2003/0118355 A1 * 6/2003 Guy ..... G03G 15/0863 399/12
2003/0170049 A1 * 9/2003 Itoh ..... G03G 15/0865 399/258
2004/0037591 A1 * 2/2004 Schlageter ..... G03G 15/0855 399/258
2004/0247344 A1 * 12/2004 Fujii ..... G03G 15/0822 399/258
2005/0041998 A1 * 2/2005 Fujii ..... G03G 15/086 399/258
2005/0157101 A1 7/2005 Silverbrook
2005/0157117 A1 * 7/2005 Silverbrook ..... B41J 2/17506 347/86
2006/0002743 A1 * 1/2006 Katsuyama ..... G03G 15/0877 399/258
2006/0029433 A1 * 2/2006 Saito ..... G03G 15/0877 399/258
2006/0263116 A1 * 11/2006 Katsuyama ..... B65D 1/0292 399/258
2007/0230999 A1 10/2007 Shimomura
2008/0025743 A1 * 1/2008 Hori ..... G03G 15/0877 399/61
2008/0166162 A1 * 7/2008 Hayashi ..... G03G 21/12 399/359
2008/0219683 A1 * 9/2008 Muramatsu ..... G03G 15/0877 399/27
2009/0110434 A1 * 4/2009 Kusudo ..... G03G 21/1821 399/109
2009/0169241 A1 * 7/2009 Mimura ..... G03G 15/0875 399/106
2009/0277911 A1 * 11/2009 Koide ..... B65D 5/603 220/495.08
2010/0092216 A1 * 4/2010 Spence ..... G03G 15/0822 399/258
2011/0097094 A1 * 4/2011 Hamano ..... G03G 15/0856 399/27
2011/0116811 A1 5/2011 Miller
2011/0217067 A1 * 9/2011 Tokuno ..... G03G 15/0872 399/110
2012/0177406 A1 * 7/2012 Suzuki ..... G03G 15/0874 399/120
2013/0187997 A1 * 7/2013 Xiao ..... G03G 15/553 347/86
2013/0272750 A1 * 10/2013 Matsumoto ..... G03G 15/0886 399/262
2014/0193166 A1 * 7/2014 Arima ..... G03G 15/0879 399/27
2014/0227008 A1 * 8/2014 Janssen ..... G03G 15/0886 399/258
2015/0015907 A1 1/2015 Karino et al.
2016/0291521 A1 * 10/2016 Nagata ..... G03G 15/0863
2017/0153575 A1 * 6/2017 Schulkes ..... G03G 15/0881
2017/0219997 A1 8/2017 Kim
2018/0093488 A1 4/2018 Jeran

FOREIGN PATENT DOCUMENTS

| | | |
|---|---|---|
| JP | 2001228691 | 8/2001 |
| JP | 2013-218199 | 10/2013 |
| JP | 201790692 | 5/2017 |
| KR | 10-2004-0006406 | 1/2004 |
| RU | 2539761 | 1/2015 |
| RU | 2606929 | 1/2017 |

* cited by examiner

[Fig. 1]
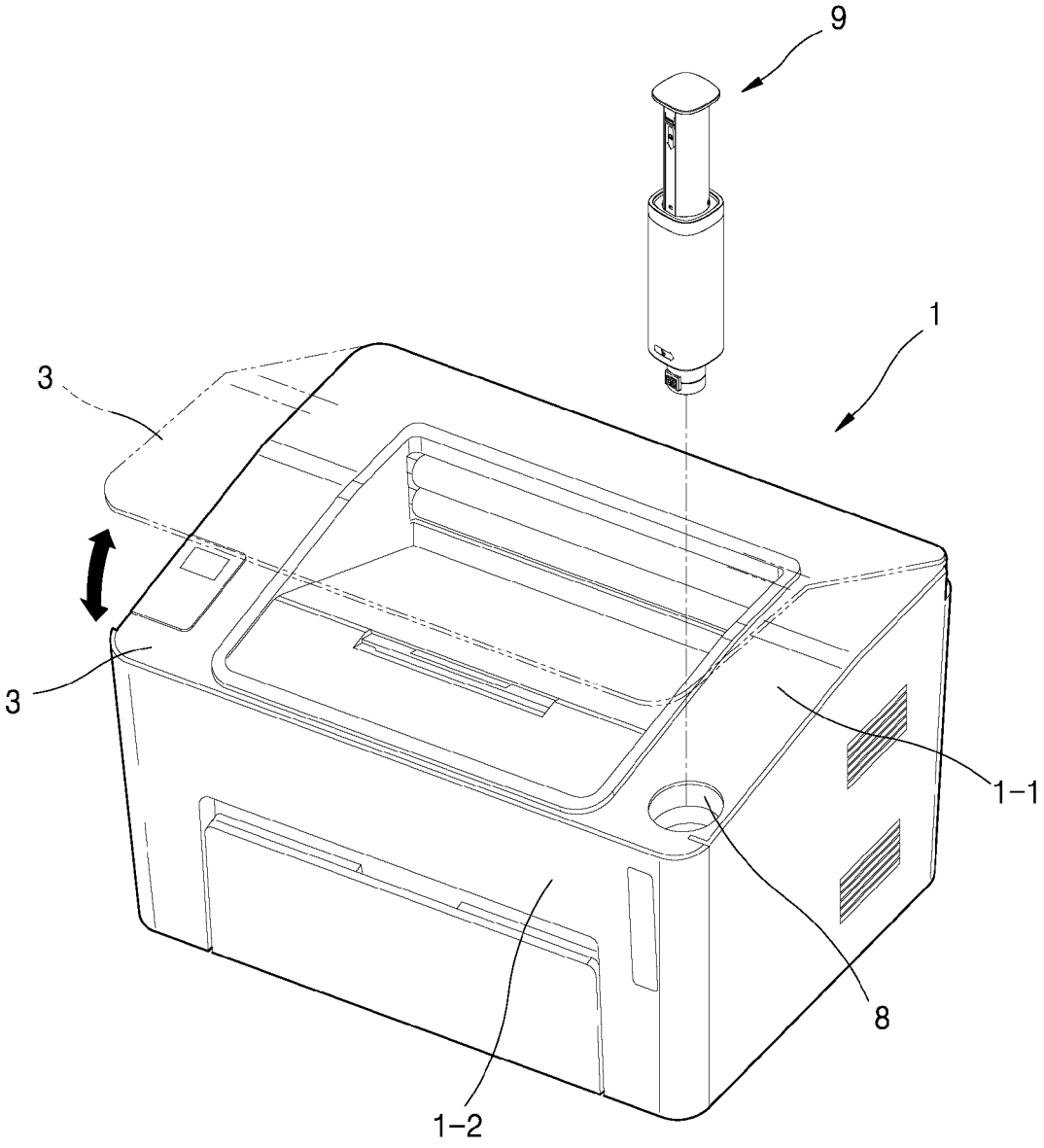

[Fig. 2]
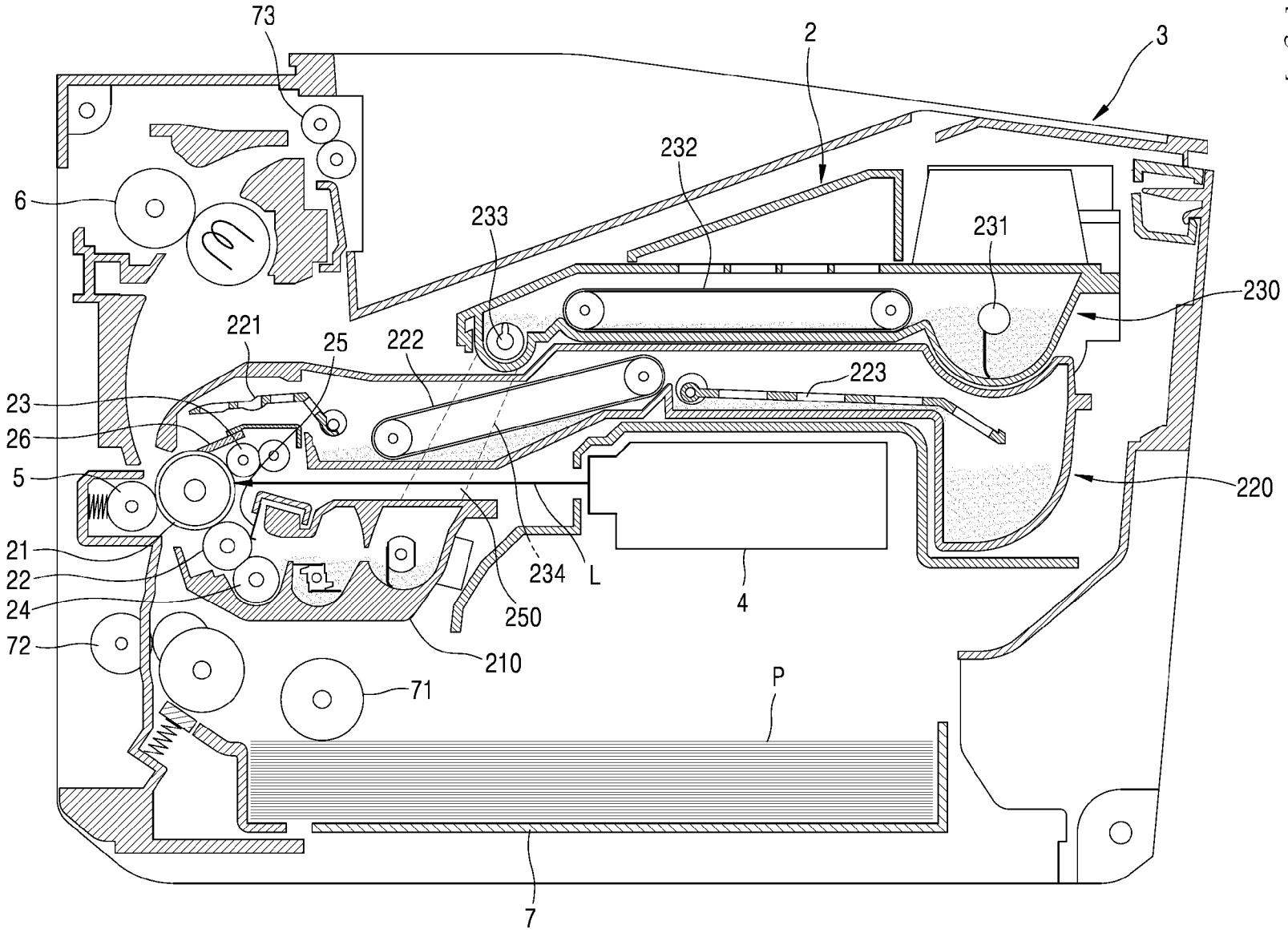

[Fig. 3]
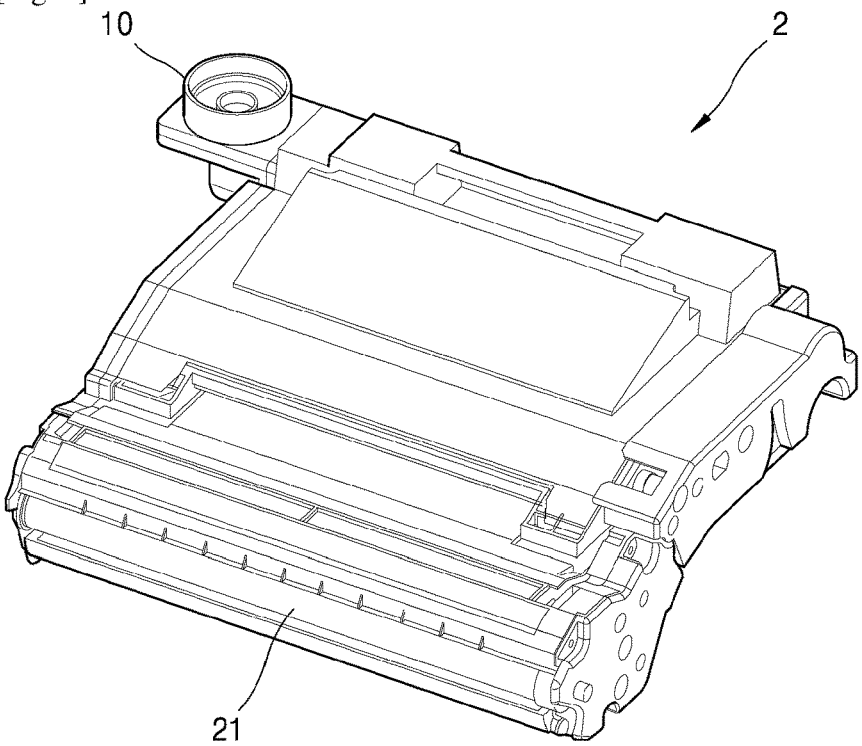
[Fig. 4]
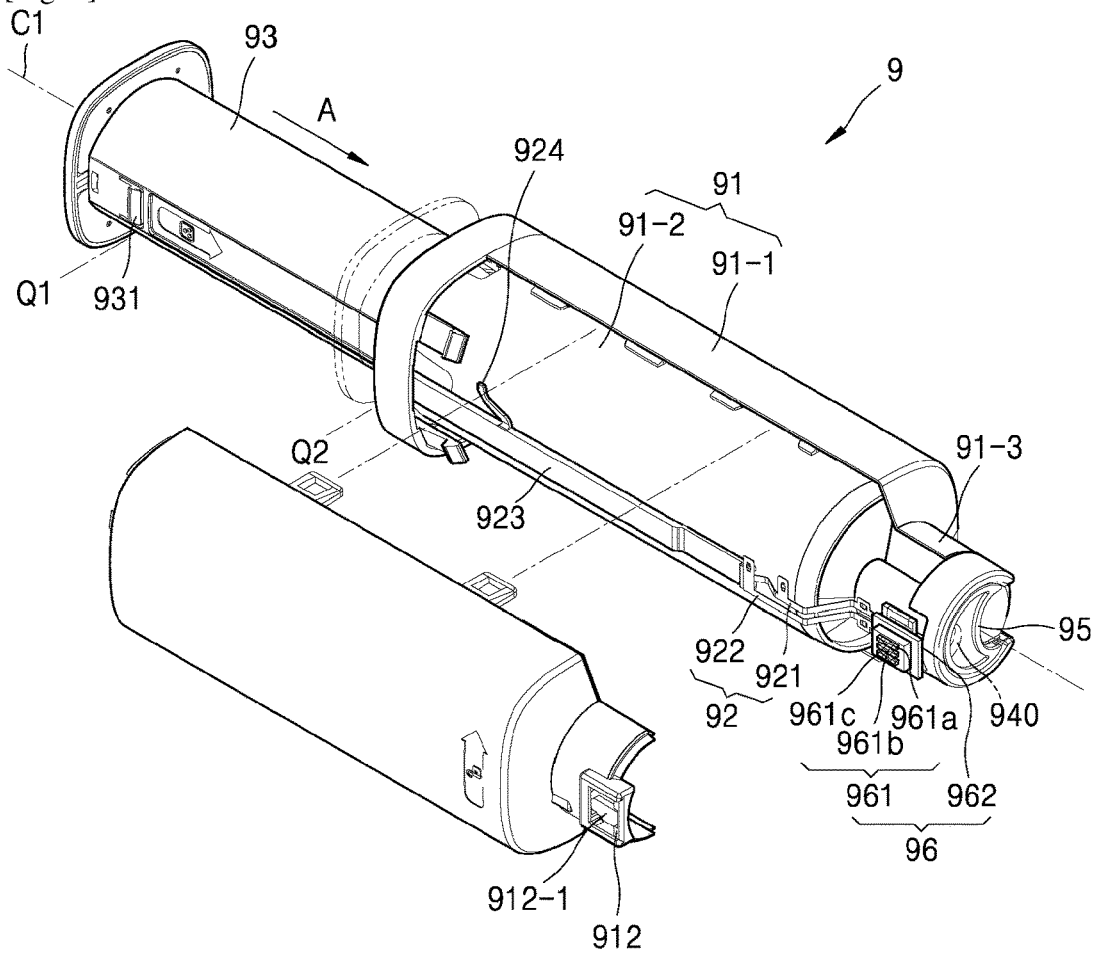

[Fig. 5A]
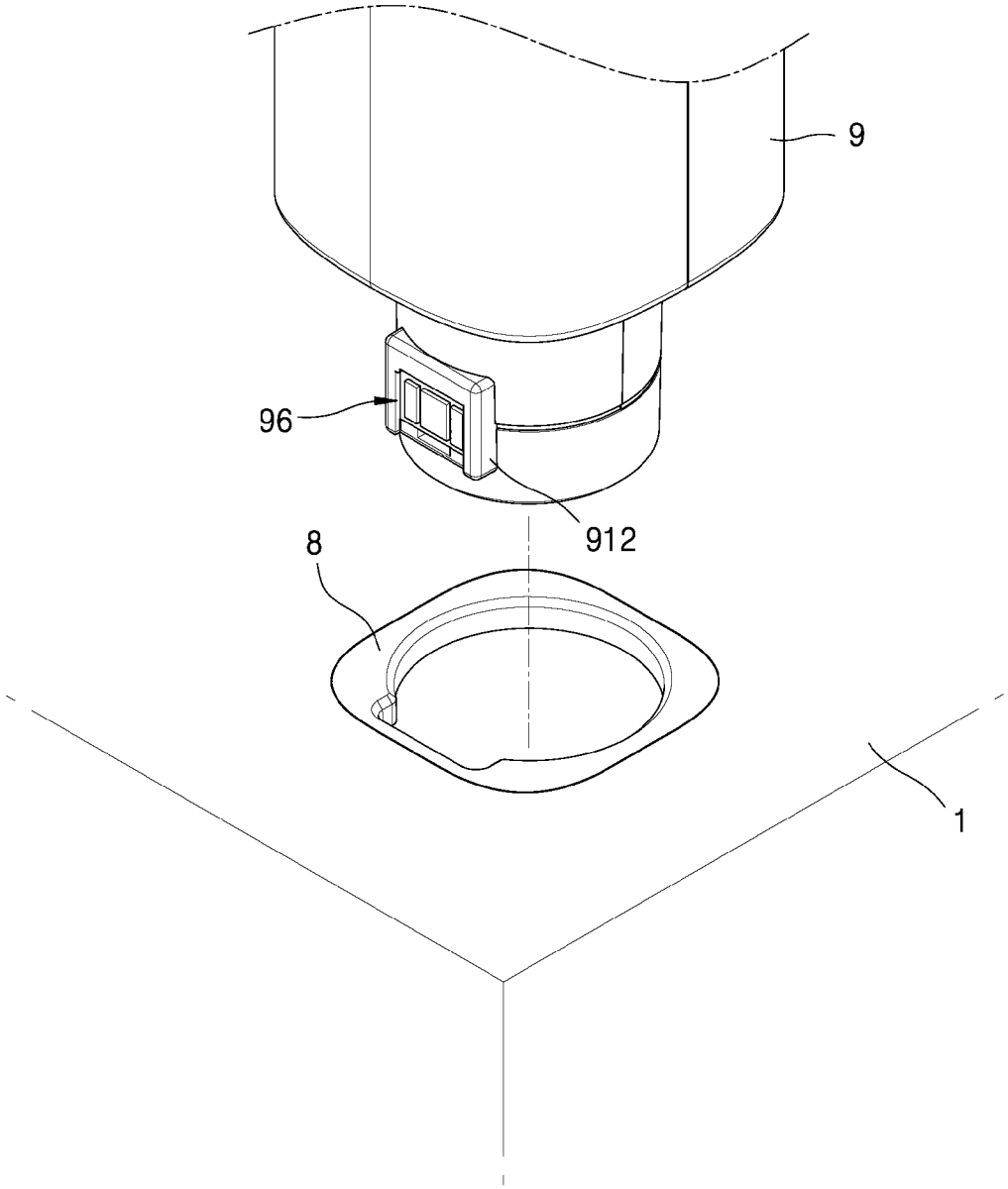

[Fig. 5B]
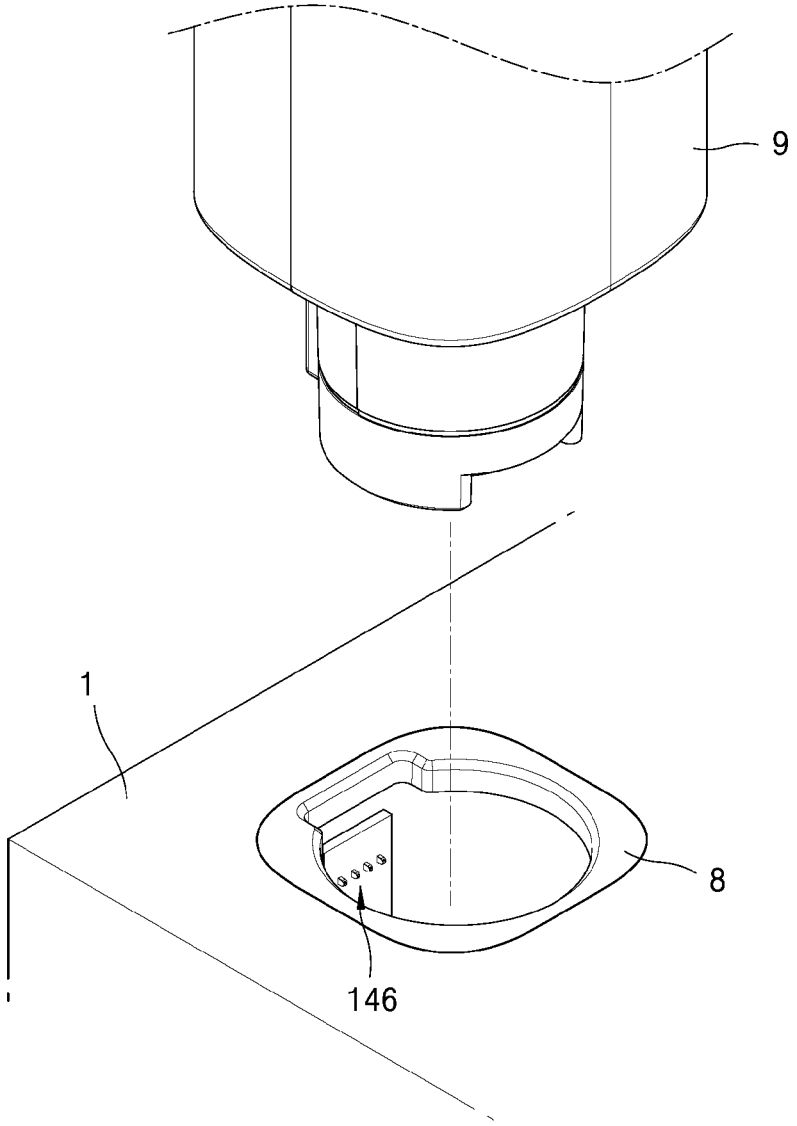

[Fig. 6]
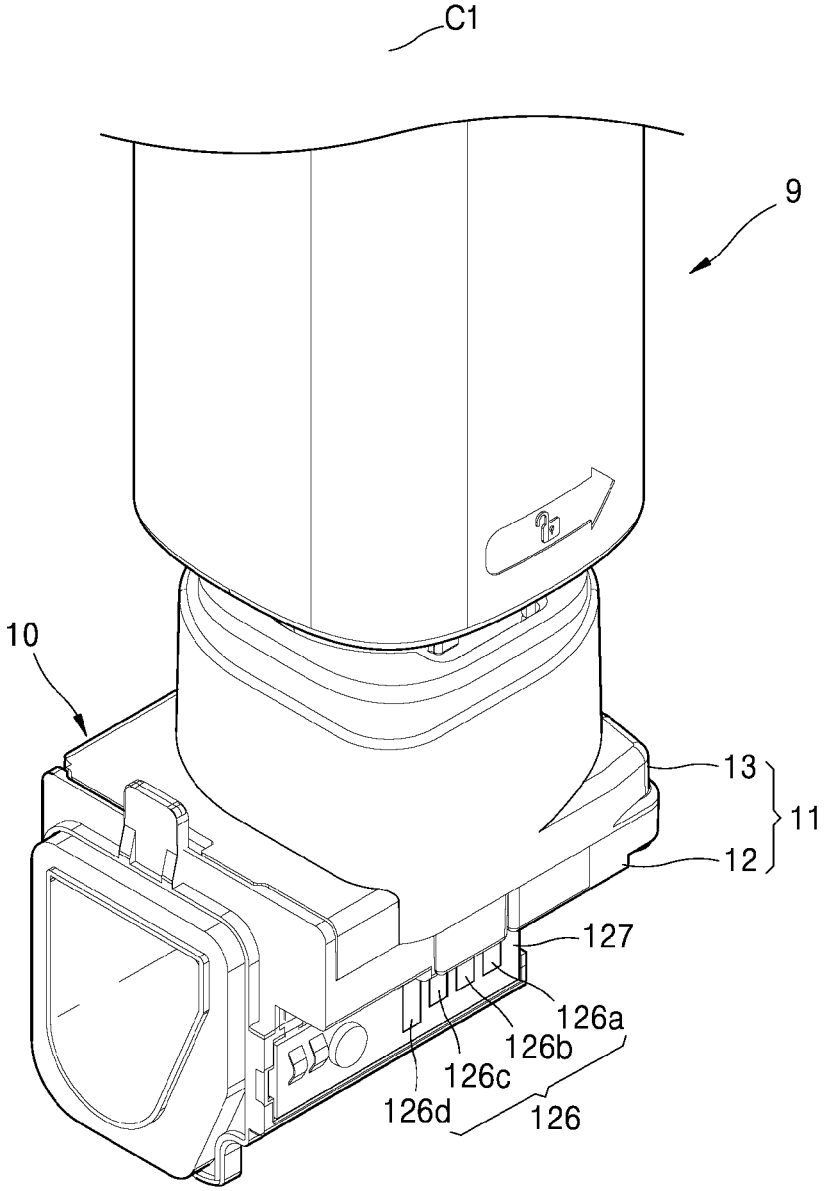

[Fig. 7]
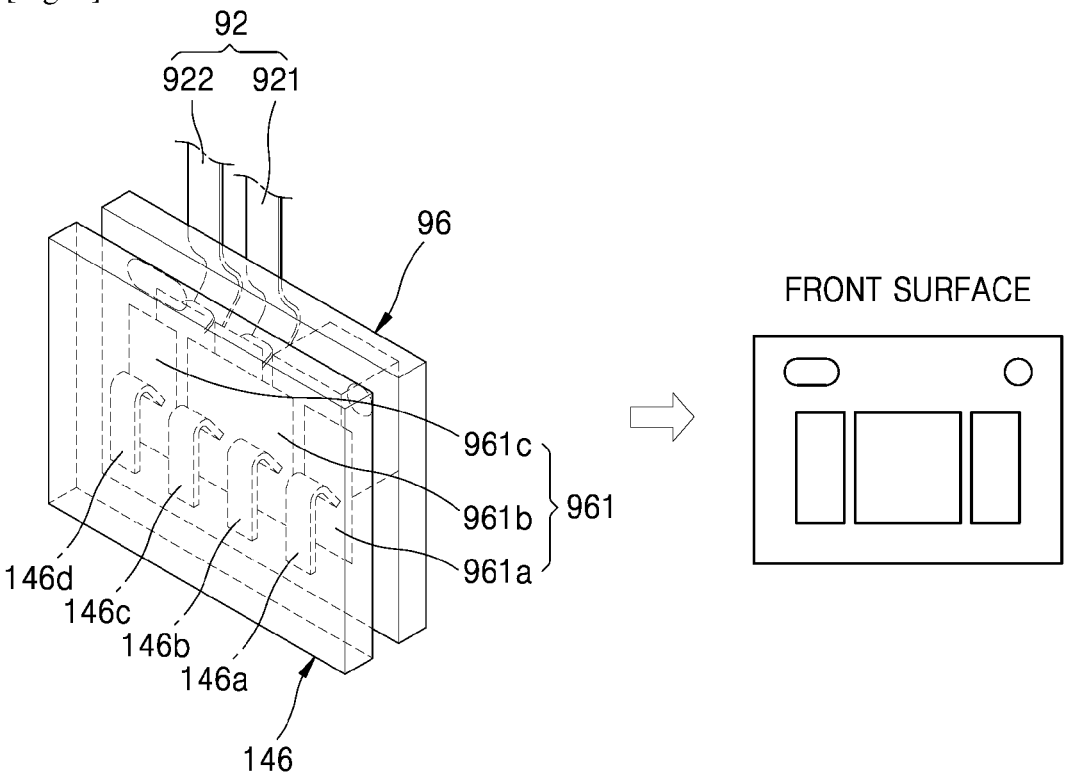
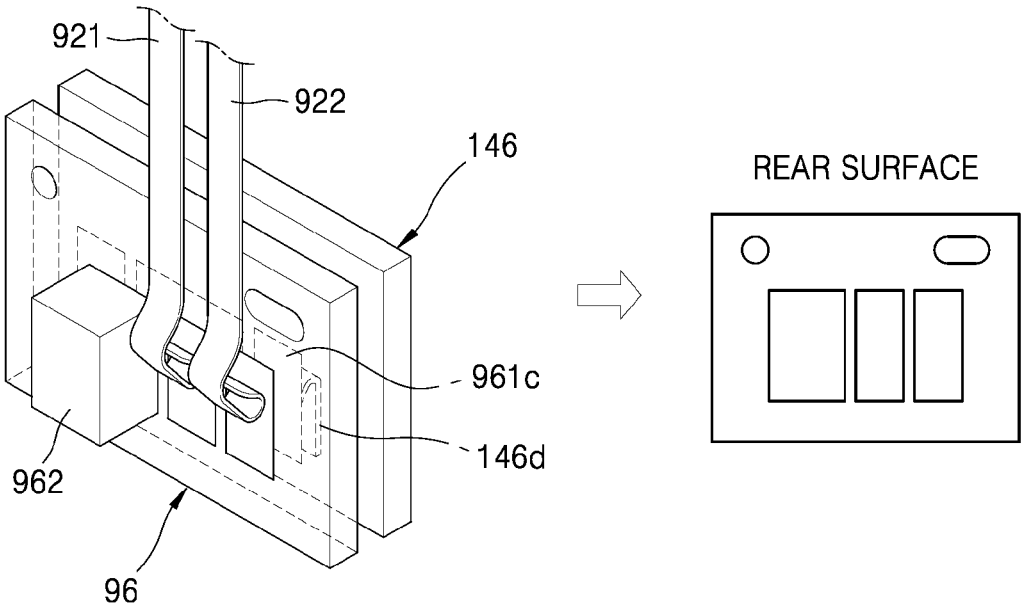

[Fig. 8]
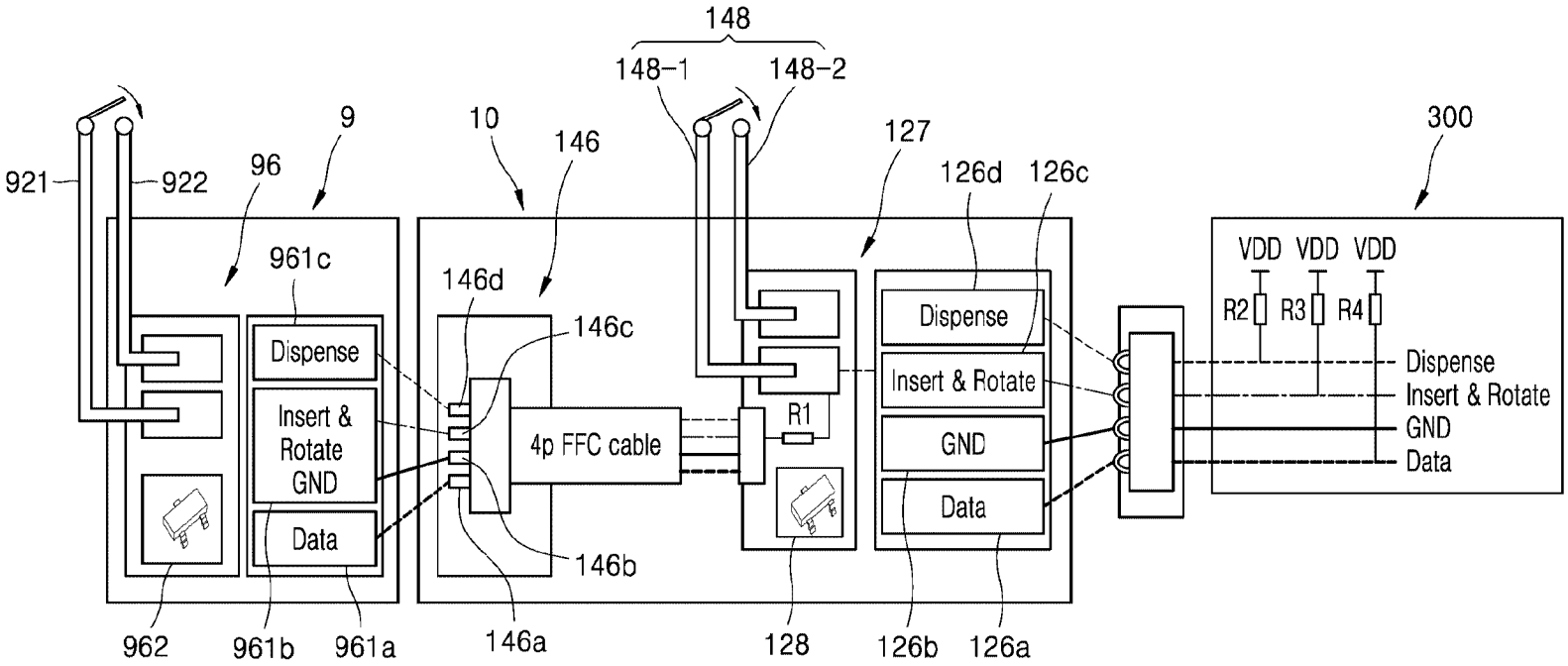

[Fig. 9]
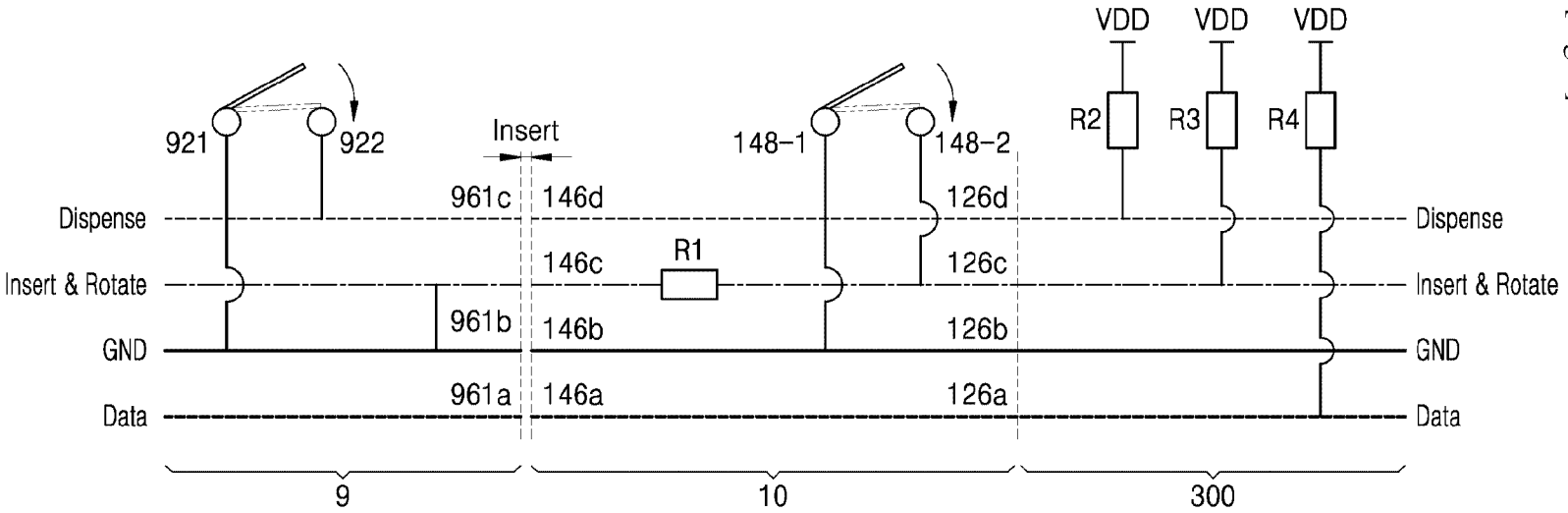

TONER REFILL CARTRIDGE CONNECTED TO MAIN BODY THROUGH INTERFACE BETWEEN DEVELOPMENT CARTRIDGE AND MAIN BODY

CROSS REFERENCE TO RELATED APPLICATIONS

This application is filed under 35 U.S.C. 0.371 as a National Stage of PCT International Application No. PCT/KR2018/014409, filed on Nov. 22, 2018, in the Korean Intellectual Property Office, which claims the priority benefit of Korean Patent Application No. 10-2018-0102566, filed on Aug. 30, 2018, in the Korean Intellectual Property Office. The disclosures of PCT International Application No. PCT/KR2018/014409 and Korean Patent Application No. 10-2018-0102566 are incorporated by reference herein in their entireties.

BACKGROUND ART

An image forming apparatus using an electrophotographic method supplies toner to an electrostatic latent image formed on a photoreceptor to form a visible toner image on the photoconductor, transfers the toner image to a printing medium via an intermediate transfer medium or directly to a printing medium, and then fixes the transferred toner image on the printing medium.

A development cartridge accommodates toner and supplies the toner to an electrostatic latent image formed on the photoreceptor to form a visible toner image. When the toner accommodated in the development cartridge is exhausted, the development cartridge is removed from a main body of the image forming apparatus and a new development cartridge may be mounted on the main body of the image forming apparatus.

DISCLOSURE OF INVENTION

Brief Description of Drawings

FIG. 1 is an external perspective view of an example of an electrophotographic image forming apparatus;

FIG. 2 is a configuration diagram of the example of the electrophotographic image forming apparatus shown in FIG. 1;

FIG. 3 is a perspective view of an example of a development cartridge adopted in the example of the electrophotographic image forming apparatus shown in FIG. 1;

FIG. 4 is a partially exploded perspective view of an example of a toner refill cartridge;

FIGS. 5A and 5B are views of a toner refill cartridge accessing a toner refilling portion from outside a main body of an image forming apparatus through a communicating portion;

FIG. 6 is a perspective view of an example of a toner refilling portion equipped with a toner refill cartridge;

FIG. 7 is a view for explaining electrical connection between a connection interface of a toner refill cartridge and a first connector of a toner refilling portion;

FIG. 8 is a view for explaining a connection structure between a toner refill cartridge, a toner refilling portion in a development cartridge, and a controller and FIG. 9 is a view for explaining information transmission between a toner refill cartridge, a toner refilling portion, and a controller when the toner refill cartridge is mounted on the toner refilling portion in a development cartridge.

MODE FOR THE INVENTION

Reference will now be made in detail to examples, examples of which are illustrated in the accompanying drawings. The same reference numerals are used to denote the same elements, and repeated descriptions thereof will be omitted.

FIG. 1 is an external perspective view of an example of an electrophotographic image forming apparatus. FIG. 2 is a configuration diagram of the example of the electrophotographic image forming apparatus shown in FIG. 1. FIG. 3 is a perspective view of an example of a development cartridge adopted in the example of the electrophotographic image forming apparatus shown in FIG. 1.

Referring to FIGS. 1 to 3, the image forming apparatus may include a main body 1 and a development cartridge 2 in the form of a cartridge removable from the main body 1. The main body 1 may include a door 3. The door 3 may open and close a portion of the main body 1. FIG. 1 shows the door 3 for opening an upper portion of the main body 1, but a door for opening a side or the whole of the main body 1 may be employed if necessary. A user may open the door 3 and mount or remove the development cartridge 2 on/from the main body 1. The main body 1 may include a communicating portion 8 such that the development cartridge 2 accesses from outside the main body 1 a toner refilling portion 10 in a state in which the development cartridge 2 is mounted on the main body 1. The communicating portion 8 may be provided at a position close to a front surface 1-2 of the main body 1. Since the front surface 1-2 faces the user, the user may easily access the communication portion 8. Therefore, a toner refilling operation using a toner refill cartridge 9 may be easily performed through the communicating portion 8. The communicating portion 8 may be provided on an upper surface 1-1 of the main body 1. The toner refilling portion 10 may be provided under the communicating portion 8. The communicating portion 8 and the toner refilling portion 10 may be aligned in a vertical direction. The toner refill cartridge 9 may access the toner refilling portion 10 from above the main body 1 through the communicating portion 8.

A photosensitive drum 21 may include a cylindrical metal pipe and a photosensitive layer with photoconductivity formed on the periphery thereof, as an example of a photoconductor on which an electrostatic latent image is provided. A charging roller 23 is an example of a charger that charges a surface of the photosensitive drum 21 to a uniform potential. A charging bias voltage may be applied to the charging roller 23. A corona charger (not shown) may also be used instead of the charging roller 23. A developing roller 22 may supply toner to an electrostatic latent image formed on the surface of the photosensitive drum 21 to develop the electrostatic latent image.

A supply roller 24 may attach the toner to the developing roller 22. A supply bias voltage may be applied to attach the toner to the supply roller 24 with the developing roller 22. A regulating member 25 may regulate the amount of toner attached to a surface of the developing roller 22. The regulating member 25 may be, for example, a regulating blade whose tip is brought into contact with the developing roller 22 at a certain pressure. A cleaning member 26 may remove residual toner and foreign materials from the surface of the photosensitive drum 21 before charging. The cleaning member 26 may be, for example, a cleaning blade whose tip is in contact with the surface of the photosensitive drum 21. Hereinafter, the foreign materials removed from the surface of the photosensitive drum 21 are referred to as waste toner.

An optical scanner 4 may scan the surface of the photosensitive drum 21 charged to a uniform potential with light modulated according to image information. As the optical scanner 4, for example, a laser scanning unit (LSU) may be employed in which light irradiated from a laser diode is deflected in a main scanning direction by using a polygon mirror to scan the photosensitive drum 21.

A transfer roller 5 is an example of a transfer unit which is located opposite the photosensitive drum 21 to form a transfer nip. A transfer bias voltage for transferring a toner image developed on the surface of the photosensitive drum 21 to a print medium P may be applied to the transfer roller 5. A corona transferor may be used instead of the transfer roller 5.

The toner image transferred to the surface of the printing medium P by the transfer roller 5 may be maintained on a surface of the printing medium P by electrostatic attraction. A fixing unit 6 may form a permanent print image on the print medium P by fixing the toner image on the print medium P by applying heat and pressure.

The development cartridge 2 according to the example may include a developing portion 210 including the photosensitive drum 21 and the developing roller 22, a waste toner accommodating portion 220 in which waste toner removed from the photosensitive drum 21 is accommodated, and a toner accommodating portion 230 connected to the developing portion and accommodating toner. In order to refill toner in the toner accommodating portion 230, the development cartridge 2 may include the toner refilling portion 10 connected to the toner accommodating portion 230. The toner refilling portion 10 provides an interface between the toner refill cartridge 9 and the development cartridge 2, which will be described later below. The development cartridge 2 may be an integrated development cartridge including the developing portion 210, the waste toner accommodating portion 220, the toner accommodating portion 230, and the toner refilling portion 10.

A portion of an outer periphery of the photosensitive drum 21 may be exposed to an outside of the housing. The transfer roller 5 may contact the exposed portion of the photosensitive drum 21 to form the transfer nip. The developing portion 210 may include one or more carrying members for carrying toner toward the developing roller 22. The carrying member may also stir toner to charge the toner to a certain potential.

The waste toner accommodating portion 220 may be located above the developing portion 210. The waste toner accommodating portion 220 may be spaced upward from the developing portion 210 to form a light path 250 therebetween. Waste toner removed from the surface of the photosensitive drum 21 by the cleaning member 26 may be accommodated in the waste toner accommodating portion 220. The waste toner removed from the surface of the photosensitive drum 21 may be transferred to the inside of the waste toner accommodating portion 220 by one or more transfer members 221, 222, and 223. The shape and the number of a waste toner transfer member are not limited. An appropriate number of waste toner transfer members may be provided at appropriate positions to effectively disperse waste toner in the waste toner accommodating portion 220 considering a volume or a shape of the waste toner accommodating portion 220.

The toner accommodating portion 230 may be connected to the toner refilling portion 10 to accommodate toner. The toner accommodating portion 230 may be connected to the developing portion 210 by a toner supply 234 as shown by dashed lines in FIG. 2. As shown in FIG. 2, the toner supply 234 may be connected to the developing portion 210 through the waste toner accommodating portion 220 in the vertical direction. The toner supply 234 may be located outside an effective width of exposure light L so as not to interfere with the exposure light L scanned in a main scanning direction by the optical scanner 4.

The toner accommodating portion 230 may include one or more toner supply members 231, 232, and 233 for supplying toner to the developing portion 210 through the toner supply 234. The shape and the number of toner supply members are not limited. An appropriate number of toner supply members may be provided at appropriate positions in the toner accommodating portion 230 to effectively supply toner to the developing portion 210 considering a volume or a shape of the toner accommodating portion 230. The toner supply member 233 may transfer toner to the toner supply 234.

An image forming process according to the above-described configuration will be briefly described. A charging bias voltage is applied to the charging roller 23, and the photosensitive drum 21 may be charged to a uniform potential. The optical scanner 4 may scan the photosensitive drum 21 with light modulated corresponding to image information to form an electrostatic latent image on the surface of the photosensitive drum 21. The supply roller 24 may attach toner to the surface of the developing roller 22. The regulating member 25 may form a toner layer having a uniform thickness on the surface of the developing roller 22. A developing bias voltage may be applied to the developing roller 22. Toner carried to the developing nip as the developing roller 22 is rotated is moved and attached to the electrostatic latent image formed on the surface of the photosensitive drum 21 by a developing bias voltage so that a visible toner image may be formed on the surface of the photosensitive drum 21. The print medium P drawn out from a loading unit 7 by a pickup roller 71 may be transferred to the transfer nip where the transfer roller 5 and the photosensitive drum 21 face each other by a feed roller 72. When a transfer bias voltage is applied to the transfer roller 5, the toner image may be transferred to the print medium P by electrostatic attraction. The toner image transferred to the printing medium P is fixed to the printing medium P by receiving heat and pressure from the fixing unit 6, whereby printing may be completed. The print medium P is discharged by a discharge roller 73. Toner remaining on the surface of the photosensitive drum 21 without being transferred to the print medium P may be removed by the cleaning member 26.

According to an example image forming apparatus, the development cartridge 2 may include the toner refilling portion 10 in order to refill toner in the development cartridge 2 in a state in which the development cartridge 2 is mounted on the main body 1 without removing the development cartridge 2 from the main body 1. The toner refilling portion 10 may be integrally formed with the development cartridge 2 and may be detached from the main body 1 together with the development cartridge 2.

FIG. 4 is a perspective view of an example of the toner refill cartridge 9. FIGS. 5A and 5B are views of the toner refill cartridge 9 accessing the toner refilling portion 10 from outside the main body 1 of the image forming apparatus through the communicating portion 8. FIG. 6 is a perspective view of an example of the toner refilling portion 10 equipped with the toner refill cartridge 9. FIG. 7 is a view for explaining an electrical connection between a connection interface 96 of the toner refill cartridge 9 and a first connector 146 of the toner refilling portion 10.

Referring to FIGS. 4 to 7, the toner refill cartridge 9 may be a syringe toner refill cartridge including a body 91 accommodating toner and having a toner discharge portion 940, and a plunger 93 which is movably coupled to the body 91 in a longitudinal direction A to push toner out of the body 91. The toner discharge portion 940 may be provided at a tip portion 91-3 of the body 91. A discharge shutter 95 may selectively open and close the toner discharge portion 940. A protruding portion 912 partially protruding outwardly may be provided at the tip portion 91-3 of the body 91.

The body 91 may include an outer body 91-1 and an inner body 91-2 located inside the outer body 91-1 and accommodating toner. The toner discharge portion 940 is provided in the inner body 91-2. The plunger 93 may be inserted into the inner body 91-2 and moved in the longitudinal direction A. The plunger 93 may be moved from an upper position Q1 to a lower position Q2. The discharge shutter 95 may be provided so as to be independently rotatable with respect to the tip portion 91-3 of the body 91. For example, as shown in FIG. 4, the discharge shutter 95 may be located in a closed position that blocks the toner discharge portion 940. Further, the discharge shutter 95 may be located at a discharge position where the discharge shutter 95 is rotated 180 degrees with respect to the body 91 to open the toner discharge portion 940. The discharge shutter 95 may be rotated with respect to a first rotation axis C1. The first rotation axis C1 may be, for example, a central axis of the cylindrical tip portion 91-3.

The toner refill cartridge 9 may include a toner injection completion signal generator 92 used for detecting completion of injection of toner. For example, referring to the example of FIG. 4, the toner injection completion signal generator 92 may include a pair of electrodes 921 and 922 provided between the outer body 91-1 and the inner body 91-2. The pair of electrodes 921 and 922 may be respectively connected to electrical contacts 961*b* and 961*c*. An electrical contact state of the pair of electrodes 921 and 922 may vary depending on a position of the plunger 93. The electrical contact state of the pair of electrodes 921 and 922 may change from a first state to a second state when the plunger 93 enters the lower position Q2. For example, the first state and the second state may be an electrical open state and an electrical short state, respectively, or vice versa. An operating lever 923 movable in the longitudinal direction A may be provided between the outer body 91-1 and the inner body 91-2 in order to change the electrical contact state of the pair of electrodes 921 and 922. The plunger 93 may include a pushing protrusion 931 which pushes the operating lever 923 when the plunger 93 enters the lower position Q2 to bring the pair of electrodes 921 and 922 into contact with or spaced from each other. A hooking member 924 provided on the operating lever 923 may be locked and fixed to a protruding portion formed on the body 91 until the plunger 93 reaches a certain position.

A connection interface 96 may be provided at the tip portion 91-3 of the body 91. When the toner refill cartridge 9 is mounted on the toner refilling portion 10, the connection interface 96 may be electrically connected to the main body 1 to transfer information of the toner refill cartridge 9 to the main body 1. In the example, the connection interface 96 may be electrically connected to the main body 1 via the first connector 146 provided in the toner refilling portion 10. The main body 1, for example, a controller provided in the main body 1, may determine whether or not the toner refill cartridge 9 is mounted depending on whether the controller is electrically connected to the connection interface 96, for example, whether the controller can communicate with the connection interface 96.

The connection interface 96 may include a circuit unit 962 for managing information of the toner refill cartridge 9 and an electrical contact portion 961 for connection with the main body 1. The circuit unit 962 may be a customer replaceable unit monitor (CRUM) including a processor for performing at least one of authentication and/or encrypted data communication with the main body 1. The circuit unit 962 may further include a memory. The memory may store various types of information for the toner refill cartridge 9. For example, information about a manufacturer, information about manufacturing date and time, unique information such as serial number, model name, and the like, various programs, digital signature information, and a usage state (e.g., how many sheets have been printed so far, how many remaining sheets can be printed, and how much toner is remaining) may be stored in the memory. In addition, information about a lifetime of the toner refill cartridge 9, setup menu, and the like may be stored in the memory. In addition, the circuit unit 962 may include functional blocks capable of performing various functions for communication authentication, encryption, and the like with the main body 1. The circuit unit 962 may be implemented in the form of a chip including a processor and/or a memory, or a printed circuit board assembly (PBA) in which circuit elements for implementing chips and various functional blocks are mounted.

The electrical contact portion 961 may have various forms such as a conductive pattern, a modular jack, a resilient terminal, and the like, which may be electrically connected to the main body 1. The electrical contact portion 961 of the example shown in FIG. 4 is a conductive pattern. The electrical contact portion 961 may be exposed to outside the body 91 through an opening 912-1 provided in the protruding portion 912.

For example, the electrical contact portion 961 may have three electrical contacts 961*a*, 961*b*, and 961*c*. The first electrical contact 961*a* may be for transmitting information stored in the memory of the circuit unit 962 to the main body 1 of the image forming apparatus. The second electrical contact 961*b* may be for transmitting a signal regarding whether or not the toner refill cartridge 9 is mounted on the toner refilling portion 10 to the main body 1 of the image forming apparatus. The third electrical contact 961*c* may be for transmitting a toner injection completion signal or a removal request signal of the toner refill cartridge 9 to the main body 1 of the image forming apparatus.

As shown in FIGS. 5A and 5B, the toner refill cartridge 9 may be mounted on the toner refilling portion 10 through the communicating portion 8 from the outer surface of the main body 1 of the image forming apparatus. FIG. 5A is a front view of the toner refill cartridge 9 when the toner refill cartridge 9 accesses the communicating portion 8. FIG. 5B is a rear view of the toner refill cartridge 9 when the toner refill cartridge 9 accesses the communicating portion 8. When the toner refill cartridge 9 is inserted into the communicating portion 8 from above the main body 1, the toner refill cartridge 9 may be mounted on the toner refilling portion 10 as shown in FIG. 6. When the plunger 93 of the toner refill cartridge 9 is pushed in the longitudinal direction A of the body 91 in a state in which the toner refill cartridge 9 is mounted on the toner refilling portion 10, toner accommodated in the body 91 may be discharged through the toner discharge portion 940 and supplied to the toner accommodating portion 230 of the development cartridge 2 through the toner refilling portion 10. The toner refill cartridge 9 may be removed from the communicating portion 8 after completion of the toner injection.

When the toner refill cartridge 9 is mounted on the toner refilling portion 10 of the image forming apparatus, the connection interface 96 of the toner refill cartridge 9 may be electrically connected to the first connector 146 located at a certain portion of the toner refilling portion 10. The connection interface 96 of the toner refill cartridge 9 may be electrically connected to the main body 1, for example, a controller provided in the main body 1 through the first connector 146 and a second connector 127 provided in the toner refilling portion 10. When the toner refill cartridge 9 is mounted on a mounting portion 11 through the insertion portion of an upper body 13, the first connector 146 may be directly connected to the electrical contact portion 961 of the connection interface 96. The first connector 146 may be connected to the second connector 127 by a flexible cable and the second connector 127 may be electrically connected to a controller provided on the main body 1.

Referring to FIGS. 6 and 7, the electrical contact portion 961 including the three electrical contacts 961*a*, 961*b*, and 961*c* may be provided on a front surface of the connection interface 96 and the circuit unit 962 including a memory for storing information about the toner refill cartridge 9 may be implemented on a rear surface of the connection interface 96. The first connector 146 may include four electrical contacts 146*a*, 146*b*, 146*c*, and 146*d*. The four electrical contacts 146*a*, 146*b*, 146*c*, and 146*d* of the first connector 146 may correspond to the three electrical contacts 961*a*, 961*b*, and 961*c* of the connection interface 96. For example, the first electrical contact 961*a* of the connection interface 96 may be electrically connected to the first electrical contact 146*a* of the first connector 146. The electrical contact 961*b* of the connection interface 96 may be electrically connected to the second electrical contact 146*b* and/or the third electrical contact 146*c* of the first connector 146. The third electrical contact 961*c* of the connection interface 96 may be electrically connected to the fourth electrical contact 146*d* of the first connector 146. The four electrical contacts 146*a*, 146*b*, 146*c*, and 146*d* may be electrically connected to the mounting portion 11, for example, the second connector 127 provided on a lower body 12 by a flexible cable. Thus, stable electrical connection between the first connector 146 and the second connector 127 may be maintained. The second connector 127 may include an electrical contact portion 126, and the electrical contact portion 126 may include four electrical contacts 126*a*, 126*b*, 126*c*, and 126*d*. The four electrical contacts 146*a*, 146*b*, 146*c*, and 146*d* of the first connector 146 may be electrically connected to the four electrical contacts 126*a*, 126*b*, 126*c*, and 126*d* of the second connector 127 by a flexible cable, respectively. As a result, when the toner refill cartridge 9 is mounted on the mounting portion 11, the second connector 127 may be electrically connected to the connection interface 96 of the toner refill cartridge 9 through the first connector 146 of the toner refilling portion 10.

FIG. 8 is a view for explaining a connection structure between the toner refill cartridge 9, the toner refilling portion 10 in the development cartridge 2, and a controller 300. FIG. 9 is a view for explaining information transmission between the toner refill cartridge 9, the toner refilling portion 10, and the controller 300 when the toner refill cartridge 9 is mounted on the toner refilling portion 10 in the development cartridge 2.

Referring to FIGS. 8 and 9, the connection structure and operation between an image forming apparatus and the toner refill cartridge 9 connected to the main body 1 of the image forming apparatus through an interface between the development cartridge 2 and the main body 1 can be seen. The development cartridge 2 and the toner refill cartridge 9 are consumables removable from the image forming apparatus, and the toner refilling portion 10 in the development cartridge 2 may utilize the same interface as that of the development cartridge 2 to connect the development cartridge 2 and the toner refill cartridge 9 to the main body 1 of the image forming apparatus.

The image forming apparatus may include the main body 1, the development cartridge 2 removable from the main body 1, the toner refilling portion 10 in the development cartridge 2, and the controller 300. The development cartridge 2 supplies toner accommodated in the toner accommodating portion 230 to an electrostatic latent image formed on a photoconductor to form a toner image, the development cartridge 2 being removable from the main body 1. The toner refilling portion 10 may be in the development cartridge 2, and the toner refill cartridge 9 for refilling toner in the toner accommodating portion 230 may be mounted on the toner refilling portion 10. The controller 300 may control operations of the image forming apparatus based on a connection between the development cartridge 2 mounted on the main body 1 and the toner refill cartridge 9 mounted on the toner refilling portion 10. The toner refilling portion 10 may connect the toner refill cartridge 9 mounted on the toner refilling portion 10 to the main body 1 through the interface between the development cartridge 2 and the main body 1. The toner refilling portion 10 may be formed integrally with the development cartridge 2.

The toner refilling portion 10 may include the first connector 146 electrically connected to the toner refill cartridge 9 mounted on the toner refilling portion 10 and the second connector 127 electrically connected to the controller 300 provided in the main body 1. The second connector 127 includes a circuit unit 128 for managing information about the development cartridge 2 and may transmit information about the toner refill cartridge 9 obtained through the first connector 146 and information about the development cartridge 2 obtained from the circuit unit 128 to the controller 300.

As shown in FIG. 8, the first connector 146 and the second connector 127 may be connected to each other by a flexible flat cable. The first connector 146 and the second connector 127 connected by the flexible flat cable may be provided as an integrated assembly in the toner refilling portion in the toner refilling portion 10. The circuit unit 128 may be arranged on a surface opposite to a contact surface of the second connector 127 on which the electrical contact portion 126 electrically connected to the main body 1 is provided. The four electrical contacts 146*a*, 146*b*, 146*c*, and 146*d* provided in the first connector 146 may be connected to the four electrical contacts 126*a*, 126*b*, 126*c*, and 126*d* provided in the second connector 127, respectively.

The toner refilling portion 10 may be electrically connected to the toner refill cartridge 9 mounted on the toner refilling portion 10 and the main body 1 and may transmit the information about the toner refill cartridge 9 and the information about the development cartridge 2 to the controller 300 through the interface between the development cartridge 2 and the main body 1. The information about the toner refill cartridge 9 may include information for authentication of the toner refill cartridge 9 and the information about the development cartridge 2 may include information for authentication of the development cartridge 2.

The controller 300 may be connected to the toner refill cartridge 9 through the second connector 127 provided in the toner refilling portion 10 and the first connector 146. The controller 300 may control operations of the image forming apparatus based on signals or information received through the plurality of electrical contacts 126*a*, 126*b*, 126*c*, and 126*d* provided in the second connector 127.

Referring to FIGS. 8 and 9, the image forming apparatus may have an electrical structure for detecting whether the toner refill cartridge 9 is mounted on the toner refilling portion 10. For example, the first connector 146 of the toner refilling portion 10 may include the electrical contact 146*c* electrically connected to the electrical contact 961*b* provided in the connection interface 96 of the toner refill cartridge 9 when the toner refill cartridge 9 is mounted on the mounting portion 11 of the toner refilling portion 10, and the electrical contact 146*c* of the first connector 146 may be connected to the controller 300 through the electrical contact 126*c* of the second connector 127. The controller 300 may detect whether the electrical contact 961*b* of the connection interface 96 is electrically connected to the electrical contact 146*c* of the first connector 146 and the electrical contact 126*c* of the second connector 127, thereby detecting whether or not the toner refill cartridge 9 has been mounted on the toner refilling portion 10. For example, when the toner refill cartridge 9 is mounted on the toner refilling portion 10, the electrical contact 961*b* of the connection interface 96 may be electrically connected to the electrical contact 126*c* of the second connector 127 through the electrical contact 146*c* of the first connector 146.

Whether or not the toner refill cartridge 9 is mounted on the toner refilling portion 10, that is, whether or not the connection interface 96 is connected to the first connector 146 may be determined by a circuit including a reference voltage VDD and two resistors R1 and R3. For example, when the toner refill cartridge 9 is not mounted on the toner refilling portion 10, no current flows through a circuit passing through the electrical contact 126*c* of the second connector 127, so that the reference voltage VDD, for example, 3.3 V, is applied to a first input port of the controller 300 connected to the electrical contact 126*c* of the second connector 127. Meanwhile, when the toner refill cartridge 9 is mounted on the toner refilling portion 10, the circuit passing through the electrical contact 126*c* of the second connector 127 may be a circuit in which the resistor R1 and the resistor R3 are connected in parallel to each other. When resistance values of the resistors R1 and R3 are identical, for example, a voltage of 1.65 V may be applied to the first input port of the controller 300. In other words, the controller 300 may detect whether or not the toner refill cartridge 9 is mounted on the toner refilling portion 10 based on a change in a voltage flowing through the second connector 127 depending on whether the toner refill cartridge 9 is mounted on the toner refilling portion 10 with respect to the reference voltage VDD applied to the controller 300, and may control the image forming apparatus according to a result of the detection.

When the toner refill cartridge 9 is mounted on the toner refilling portion 10, the circuit unit 962 provided in the connection interface 96 of the toner refill cartridge 9 may be connected to a data input port of the controller 300 through the electrical contact 961*a* of the connection interface 96, the electrical contact 146*a* of the first connector 146, and the electrical contact 126*a* of the second connector 127. The controller 300 may read information about the toner refill cartridge 9 from the circuit unit 962 provided in the connection interface 96 of the toner refill cartridge 9. The information about the toner refill cartridge 9 may include information for authentication of the toner refill cartridge 9. Meanwhile, when the development cartridge 2 is mounted on the main body 1 of the image forming apparatus, the circuit unit 128 provided in the second connector 127 of the toner refilling portion 10 may be connected to the data input port of the controller 300 through the electrical contact 126*a* of the second connector 127. The controller 300 may read information about the development cartridge 2 from the circuit unit 128 provided in the second connector 127 of the toner refilling portion 10. The information about the development cartridge 2 may include information for authentication of the development cartridge 2. Therefore, the controller 300 may receive the information about the toner refill cartridge 9 and the information about the development cartridge 2 through the interface between the development cartridge 2 and the main body 1.

Meanwhile, the toner refilling portion 10 may include a rotation detection sensor 148 for detecting that the toner refill cartridge 9 mounted on the toner refilling portion 10 enters a certain position depending on the rotation of the toner refill cartridge 9. The rotation detecting sensor 148 may include a pair of electrodes 148-1 and 148-2 whose electrical connection state changes depending on a result of the rotation detection of the toner refill cartridge 9. The toner refilling portion 10 may transmit whether or not the mounted toner refill cartridge 9 has reached a certain position by rotation to the controller 300 through the second connector 127, based on a result of the detection of the toner refill cartridge 9.

For example, the rotation detection sensor 148 may change an electrical contact state of the pair of electrodes 148-1 and 148-2 when an inlet shutter (not shown) provided in the mounting portion 11 of the toner refilling portion 10 enters a certain position as the inlet shutter rotates in conjunction with the rotation of the toner refill cartridge 9. One of the pair of electrodes 148-1 and 148-2 may be a fixed electrode and the other electrode may be an elastic electrode that can be elastically contacted/separated to/from the fixed electrode. The pair of electrodes 148-1 and 148-2 may be connected to the controller 300 through the electrical contact 126*c* provided in the second connector 127. The electrical contact state of the pair of electrodes 148-1 and 148-2 may change from a first state to a second state when the inlet shutter (not shown) rotating in conjunction with the rotation of the toner refill cartridge 9 mounted on the toner refilling portion 10 enters a certain position. The first state and the second state may be an electrical open state and an electrical short state, respectively, or vice versa.

As described above, when a reference voltage applied to the controller 300 is 3.3 V and resistance values of the resistors R1 and R3 are identical and when the toner refill cartridge 9 is mounted on the toner refilling portion 10, a voltage of 1.65 V may be applied to the controller 300 by the voltage flowing through the second connector 127. Here, when the toner refill cartridge 9 mounted on the toner refilling portion 10 rotates, the electrical contact state of the pair of electrodes 148-1 and 148-2 provided in the toner refilling portion 10 is changed from the electrical open state to the electrical short state and a voltage of 0 V may be applied to the first input port of the controller 300. Accordingly, the controller 300 may detect whether or not the toner refill cartridge 9 rotates based on the change in the voltage flowing through the second connector 127 depending on the rotation of the toner refill cartridge 9 with respect to the reference voltage VDD applied to the controller 300, and may control the image forming apparatus according to a result of the detection.

When the toner refill cartridge 9 is rotated to allow toner contained in the toner refill cartridge 9 to be injected into the toner accommodating portion 230 of the image forming apparatus, a user may push the plunger 93 to refill toner into the toner accommodating portion 230 through the toner refilling portion 10. Completion of the toner injection may be detected by the toner injection completion signal generator 92. When the plunger 93 enters the lower position Q2, the pushing protrusion 931 may push the operating lever 923 to bring the pair of electrodes 921 and 922 into contact with each other. One of the pair of electrodes 921 and 922 may be a fixed electrode and the other electrode may be an elastic electrode that can be elastically contacted/separated to/from the fixed electrode. Accordingly, 0 V may be applied to a second input port of the controller 300 to which the reference voltage of 3.3 V is applied until toner injection is completed. That is, 0 V may be applied to both the first input port and the second input port of the controller 300. Accordingly, the controller 300 may detect toner injection completion of the toner refill cartridge 9 based on the change in the voltage flowing through the second connector 127 depending on whether or not the toner injection of the toner refill cartridge 9 is completed with respect to the reference voltage VDD applied to the controller 300, and may control the image forming apparatus according to a result of the detection.

In order to remove the toner refill cartridge 9, the toner refill cartridge 9 may be rotated in a direction opposite to a direction in which the toner refill cartridge 9 is rotated after being mounted on the toner refilling portion 10. Accordingly, the inlet shutter (not shown) rotated together with the rotation of the toner refill cartridge 9 may be returned to its original position. A voltage of 1.65 V instead a voltage of 0 V may be applied to the first input port of the controller 300 again. When the toner injection of the toner refill cartridge 9 is completed and the toner refill cartridge 9 is unlocked by rotating the toner refill cartridge 9 in a direction opposite to a direction in which the toner refill cartridge 9 is rotated after being mounted on the toner refilling portion 10, a user may separate the toner refill cartridge 9 from the toner refilling portion 10. Accordingly, a signal of 3.3 V may be input to the first input port of the controller 300 again.

It should be understood that the disclosure described herein should be considered in a descriptive sense and not for purposes of limitation. Descriptions of features within each example should be considered as available for other similar features in other examples. Therefore, the scope of the disclosure is defined not by the detailed description of the disclosure but by the appended claims.

The invention claimed is:

1. An image forming apparatus, comprising:

a main body to mount a removable development cartridge that is to supply toner accommodated in a toner accommodating portion of the development cartridge to an electrostatic latent image formed on a photoconductor of the image forming apparatus to form a toner image;

a communicating portion formed in an exterior surface of the main body to receive a toner refill cartridge, the toner refill cartridge connectable to a toner refilling portion in the development cartridge to refill toner in the toner accommodating portion via the communicating portion when the development cartridge is mounted in the main body and the toner refill cartridge is received by the communicating portion; and a controller to control operations of the image forming apparatus based on a connection status between the development cartridge and the toner refill cartridge and to control the image forming apparatus according to whether the toner refilling portion detects that the toner refill cartridge has entered a specified position based on a rotation of the toner refill cartridge when the toner refill cartridge is connected to the toner refilling portion.

2. The image forming apparatus of claim 1, wherein the toner refilling portion includes:

a first connector to be electrically connected to the toner refill cartridge when the toner refill cartridge is connected to the toner refilling portion via the communicating portion, and a second connector including a circuit unit to manage information about the development cartridge, to transmit information about the toner refill cartridge obtained through the first connector to the controller, and to transmit information about the development cartridge obtained from the circuit unit to the controller.

3. The image forming apparatus of claim 2, wherein the first connector and the second connector are connected to each other by a flexible flat cable.

4. The image forming apparatus of claim 3, wherein the first connector and the second connector are provided as an integrated assembly in the toner refilling portion.

5. The image forming apparatus of claim 2, wherein the circuit unit is provided on a surface of the second connector opposite to a contact surface of the second connector on which an electrical contact portion electrically connected to the main body is provided.

6. The image forming apparatus of claim 2, wherein a plurality of electrical contacts provided in the first connector are connected to a plurality of electrical contacts provided in the second connector, respectively.

7. The image forming apparatus of claim 2, wherein the controller is to detect whether the toner refill cartridge is connected to the toner refilling portion based on a change in a voltage flowing through the second connector and a reference voltage applied to the controller, and to control the image forming apparatus according to a result of the detection.

8. The image forming apparatus of claim 2, wherein the toner refilling portion further includes a rotation detection sensor to detect whether the toner refill cartridge enters the specified position based on a rotation of the toner refill cartridge, when the toner refill cartridge is connected to the toner refilling portion, and the controller is to detect whether the toner refill cartridge rotates when the toner refill cartridge is connected to the toner refilling portion based on a change in a voltage flowing through the second connector and a reference voltage applied to the controller, and to control the image forming apparatus according to a result of the detection.

9. The image forming apparatus of claim 2, wherein the controller is to detect toner injection completion of the toner refill cartridge based on a change in a voltage flowing through the second connector and a reference voltage applied to the controller, and to control the image forming apparatus according to a result of the detection.

10. The image forming apparatus of claim 1, wherein when the development cartridge is mounted in the main body and the toner refill cartridge is connected to the toner refilling portion in the development cartridge, the toner refilling portion is electrically connected to the toner refill cartridge and the controller, and the controller is to receive information about the toner refill cartridge and information about the development cartridge from the development cartridge.

11. The image forming apparatus of claim 10, wherein the information about the toner refill cartridge includes information for authentication of the toner refill cartridge and the information about the development cartridge includes information for authentication of the development cartridge.

12. The image forming apparatus of claim 1, wherein the toner refilling portion is formed integrally with the development cartridge.

13. A development cartridge mountable in an image forming apparatus, the development cartridge comprising:

a toner accommodating portion to accommodate toner; and a toner refilling portion, connectable to a toner refill cartridge via a communicating portion formed in an exterior surface of the main body of the image forming apparatus when the development cartridge is mounted in the image forming apparatus, to refill toner in the toner accommodating portion, the toner refilling portion to detect whether the toner refill cartridge has reached the specified position based on a rotation of the toner refill cartridge when the toner refill cartridge is connected to the toner refilling portion, the toner refilling portion including:

a first connector to be electrically connected to the toner refill cartridge when the toner refill cartridge is connected to the toner refilling portion, and a second connector including a circuit unit to transmit information about the toner refill cartridge obtained through the first connector to the controller of the image forming apparatus, and to transmit information about the development cartridge obtained from the circuit unit to the controller.

14. The development cartridge of claim 13, wherein the toner refilling portion further includes a flexible flat cable to connect the first connector and the second connector.

15. The development cartridge of claim 13, wherein the toner refilling portion further includes a rotation detection sensor to detect whether the toner refill cartridge enters the specified position based on a rotation of the toner refill cartridge, when the toner refill cartridge is connected to the toner refilling portion, and the toner refilling portion is to transmit whether the toner refill cartridge has reached the specified position to the controller via the second connector, based on a result of the detection.

* * * * *